US008833519B1

(12) United States Patent
Glazer et al.

(10) Patent No.: US 8,833,519 B1
(45) Date of Patent: Sep. 16, 2014

(54) VEHICLE MOUNTED TELESCOPIC BOOM STRUCTURE

(71) Applicants: James M. Glazer, Omaha, NE (US); Dean H. Smith, Eagle, NE (US)

(72) Inventors: James M. Glazer, Omaha, NE (US); Dean H. Smith, Eagle, NE (US)

(73) Assignee: Westchester Capital, LLC, Omaha, NE (US)

( * ) Notice: Subject to any disclaimer, the term of this patent is extended or adjusted under 35 U.S.C. 154(b) by 1 day.

(21) Appl. No.: 13/776,819

(22) Filed: Feb. 26, 2013

Related U.S. Application Data

(60) Provisional application No. 61/605,305, filed on Mar. 1, 2012.

(51) Int. Cl.
*E06C 1/00* (2006.01)
*B66F 11/04* (2006.01)

(52) U.S. Cl.
CPC ..... *B66F 11/046* (2013.01)
USPC ..... 182/69.4; 182/2.11; 182/2.1

(58) Field of Classification Search
CPC ..... B66F 11/046; B66F 11/044
USPC ..... 182/2.11, 2.1, 69.4
See application file for complete search history.

(56) References Cited

U.S. PATENT DOCUMENTS

| | | | | | |
|---|---|---|---|---|---|
| 3,173,511 | A * | 3/1965 | Verrell et al. | 182/2.11 |
| 3,231,044 | A * | 1/1966 | Myers | 182/141 |
| 3,306,470 | A * | 2/1967 | Green et al. | 212/300 |
| 3,572,467 | A * | 3/1971 | Hall | 182/2.5 |
| 3,572,517 | A * | 3/1971 | Liebherr et al. | 212/300 |
| 3,732,988 | A * | 5/1973 | Lamer | 212/300 |
| 3,767,007 | A * | 10/1973 | Garnett | 182/2.5 |
| 3,834,488 | A * | 9/1974 | Grove | 182/2.11 |
| 4,091,936 | A * | 5/1978 | Wuerflein et al. | 212/177 |
| 4,314,622 | A * | 2/1982 | Lindquist | 182/2.11 |
| 4,431,109 | A * | 2/1984 | Behrendt et al. | 212/177 |
| 4,512,436 | A * | 4/1985 | Freudenthal et al. | 182/2.2 |
| 4,602,462 | A * | 7/1986 | Anderson | 52/119 |
| 4,946,003 | A * | 8/1990 | Walbridge | 182/2.11 |
| 4,962,827 | A * | 10/1990 | Garnett | 182/2.11 |
| 5,584,356 | A * | 12/1996 | Goodrich | 182/63.1 |
| 5,913,379 | A * | 6/1999 | Young et al. | 182/2.7 |
| 6,024,191 | A * | 2/2000 | Backer et al. | 182/69.6 |
| 7,246,684 | B2 * | 7/2007 | Bean | 187/224 |
| 7,337,912 | B1 | 3/2008 | Hull | |
| 7,878,346 | B1 | 2/2011 | Watts et al. | |
| 7,926,670 | B2 * | 4/2011 | Schneider | 212/168 |
| 2008/0197094 | A1 * | 8/2008 | Bond | 212/300 |
| 2010/0276386 | A1 * | 11/2010 | Schneider | 212/291 |

* cited by examiner

*Primary Examiner* — Katherine Mitchell
*Assistant Examiner* — Candace L Bradford
(74) *Attorney, Agent, or Firm* — Dennis L. Thomte; Thomte Patent Law Office LLC

(57) ABSTRACT

A vehicle mounted telescopic boom structure including a stowable jib boom and a stowable extension boom pivotally secured thereto as well as a personnel basket which is secured to the outer end of the extension boom. When the boom structure, jib boom, extension boom and personnel basket are in their stowed position, the personnel basket is stowed on the deck of the vehicle beneath the jib boom and boom structure.

2 Claims, 8 Drawing Sheets

VEHICLE MOUNTED TELESCOPIC BOOM STRUCTURE

CROSS REFERENCE TO RELATED APPLICATION

This is a non-provisional application claiming priority from Application Ser. No. 61/605,305, filed Mar. 1, 2012 entitled TRUCK MOUNTED TELESCOPIC BOOM STRUCTURE.

BACKGROUND OF THE INVENTION

1. Field of the Invention

This invention relates to a telescopic boom structure and more particularly to a vehicle mounted telescopic boom structure. Even more particularly, this invention relates to a vehicle mounted telescopic boom structure which includes a swing-under extension boom which is pivotally secured to the outer end of a jib boom which is pivotally secured to the outer end of the boom structure. A personnel basket is secured to the outer end of the extension boom. The personnel basket remains attached to the extension boom and is stowed on the deck of the vehicle when the boom structure, jib boom and extension boom are in their stowed positions.

2. Description of the Related Art

In the construction or maintenance of tall power or transmission lines, access to the work thereon is accomplished with a long boom, boom trucks (cranes) with swing around extensions (jibs) and manned basket attachments. The problem with the prior art truck mounted telescopic boom structures is that the personnel basket which is secured to the outer end of the jib boom must be disconnected from the jib boom when the boom structure and jib boom are in their stowed positions so that the personnel basket may be stowed on the deck of the truck.

In the prior art boom structures, when it is desired to operate the boom structure, the personnel basket, which had previously disconnected from the jib boom, must be lifted from the deck and moved many feet away from the truck and placed on the ground. The boom structure is then raised and pivoted from its stowed position with respect to the truck with the jib boom then being pivotally moved to its extended or operative position. The boom structure, jib boom and personnel basket must be manipulated so as to permit the personnel basket to be attached to the outer end of the jib boom. When the job has been finished, or the truck is going to be moved to another power pole, the personnel basket is placed on the ground and the jib boom is disconnected therefrom. The jib boom and boom structure are then moved to their stowed positions and the personnel basket is then moved to the deck of the truck. The requirement that the personnel basket be connected to the jib boom and disconnected from the jib boom as described above involves extensive time and manpower.

U.S. Pat. No. 9,926,670 which is owned by the assignee of the instant invention, describes a stowable jib boom with a stowable personnel basket. Although the invention of the '670 Patent does permit the personnel basket to be stowed on the deck of the truck without disconnecting the personnel basket from the jib boom, the personnel basket must be designed so as to be fairly narrow so as to not exceed the highway overwidth restrictions since the basket is stowed at one side of the boom structure and jib boom.

SUMMARY OF THE INVENTION

This Summary is provided to introduce a selection of concepts in a simplified form that are further described below in the Detailed Description. This Summary is not intended to identify key aspects or essential aspects of the claimed subject matter. Moreover, this Summary is not intended for use as an aid in determining the scope of the claimed subject matter.

A vehicle mounted telescopic boom structure is provided with the vehicle having forward and rearward ends and opposite sides. The vehicle includes a cab at the forward end thereof and a deck, having rearward and forward ends, and opposite sides, extending rearwardly from the cab. An upstanding pedestal is rotatably mounted about a vertical axis on the vehicle adjacent the rearward end of the deck. A telescoping main boom structure is mounted on the deck and includes an elongated outer boom section, having inner and outer ends and opposite sides, with at least one elongated inner boom section, having inner and outer ends, telescopically received thereby. The inner end of the telescoping boom structure is pivotally secured to the upstanding pedestal. The boom structure is movable between a stowed position and an operative position in conventional fashion.

An elongated jib boom having inner and outer ends is also provided. The inner end of the jib boom is pivotally secured to the outer end of the inner boom section of the boom structure whereby the jib boom is movable between a first operative position and a second stowed position relative to the boom structure. The jib boom, when in its first operative position, is generally parallel to and extends outwardly from the inner boom section. The jib boom, when in its second stowed position, extends from the outer end of the inner boom structure towards the inner end of the boom structure adjacent one side of the outer boom section. An elongated extension boom is also provided which has first and second ends. The first end of the extension boom is pivotally secured about a vertical axis to the outer end of the jib boom whereby the extension boom is movable from a first stowed position beneath the jib boom to operative angular positions with respect to the jib boom. A personnel basket is pivotally secured, about a horizontal axis, to the second end of the extension boom.

The pivotal connection of the outer end of the jib boom and the first end of the extension boom and the pivotal connection of the extension boom and the personnel basket permits the personnel basket to be placed on the deck of the vehicle adjacent the forward end of the deck below the boom structure and jib boom when the boom structure, jib boom and extension boom are in their stowed positions.

It is therefore a principal object of the invention to provide a vehicle mounted telescopic boom structure including a stowable personnel basket.

A further object of the invention is to provide a vehicle mounted telescopic boom structure including an extension boom which is pivotally secured to the outer end of a jib boom in a way so that the extension boom, when in its stowed position, is positioned below the jib boom to enable the personnel basket to be stowed on the deck of the vehicle.

A further object of the invention is to provide a stowable personnel basket which permits the personnel basket to be stowed beneath the jib boom when the boom structure and the jib boom are in their stowed positions.

A further object of the invention is to provide a device of the type described wherein the personnel basket does not have to be removed from the extension boom when the boom structure, jib boom and extension boom are in their stowed positions.

A further object of the invention is to provide a device of the type described which is convenient and safe to use.

These and other objects will be apparent to those skilled in the art.

BRIEF DESCRIPTION OF THE DRAWINGS

Non-limiting and non-exhaustive embodiments of the present invention are described with reference to the following figures, wherein like reference numerals refer to like parts throughout the various views unless otherwise specified.

DESCRIPTION OF THE PREFERRED EMBODIMENT

Embodiments are described more fully below with reference to the accompanying figures, which form a part hereof and show, by way of illustration, specific exemplary embodiments. These embodiments are disclosed in sufficient detail to enable those skilled in the art to practice the invention. However, embodiments may be implemented in many different forms and should not be construed as being limited to the embodiments set forth herein. The following detailed description is, therefore, not to be taken in a limiting sense in that the scope of the present invention is defined only by the appended claims.

Figure 2:
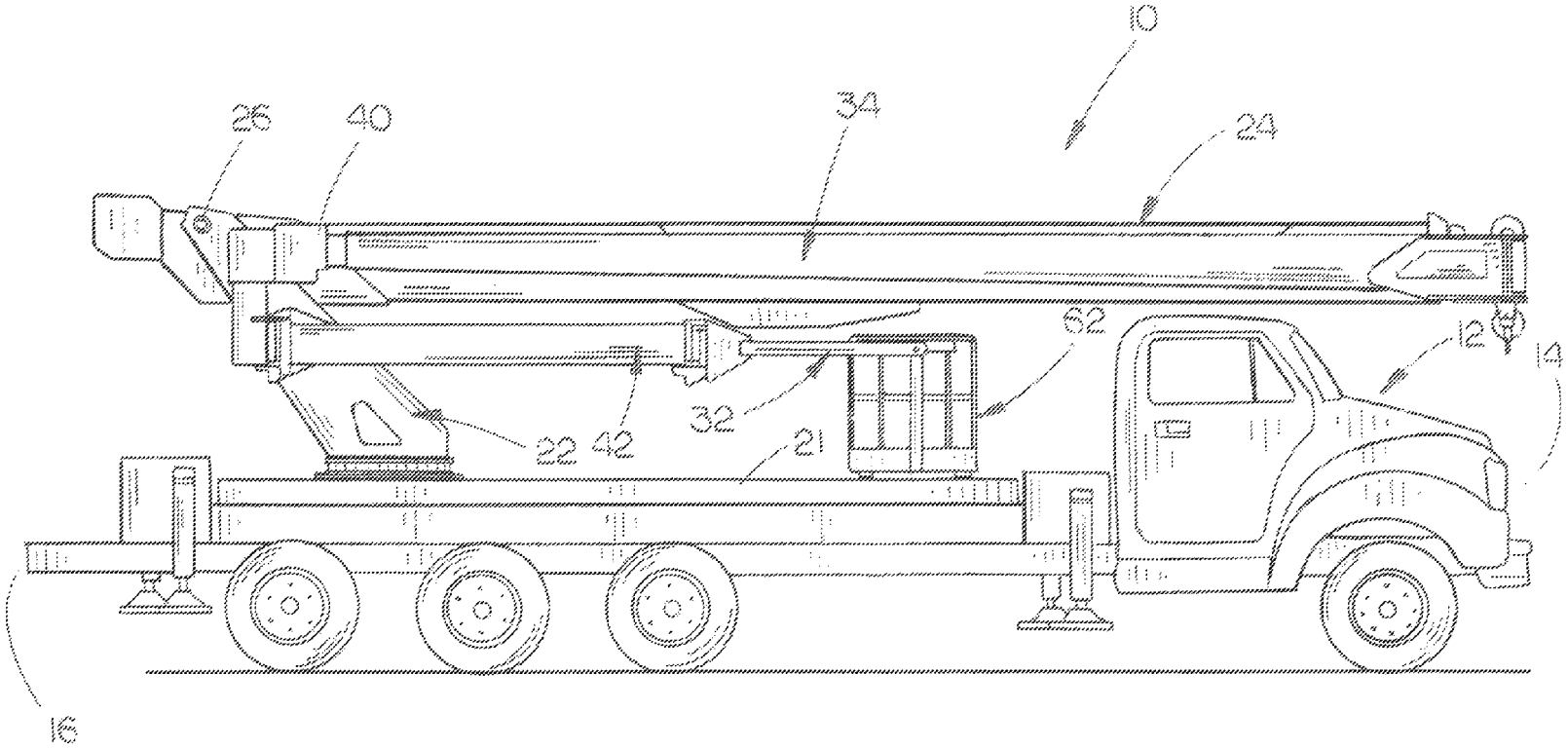
FIG. 2 is a side view of the vehicle mounted telescopic boom structure of this invention with the main boom, jib boom, extension boom and personnel basket in a stowed position.

The numeral 10 refers generally to a vehicle mounted boom structure with the numeral 12 referring to the vehicle including a forward end 14, rearward end 16, opposite sides 18 and 20, and deck 21. The numeral 22 refers to a conventional rotatable pedestal having a telescopic boom structure 24 pivotally secured thereto about a horizontal axis referred to generally by the reference numeral 26 (FIG. 2).

Figure 3:
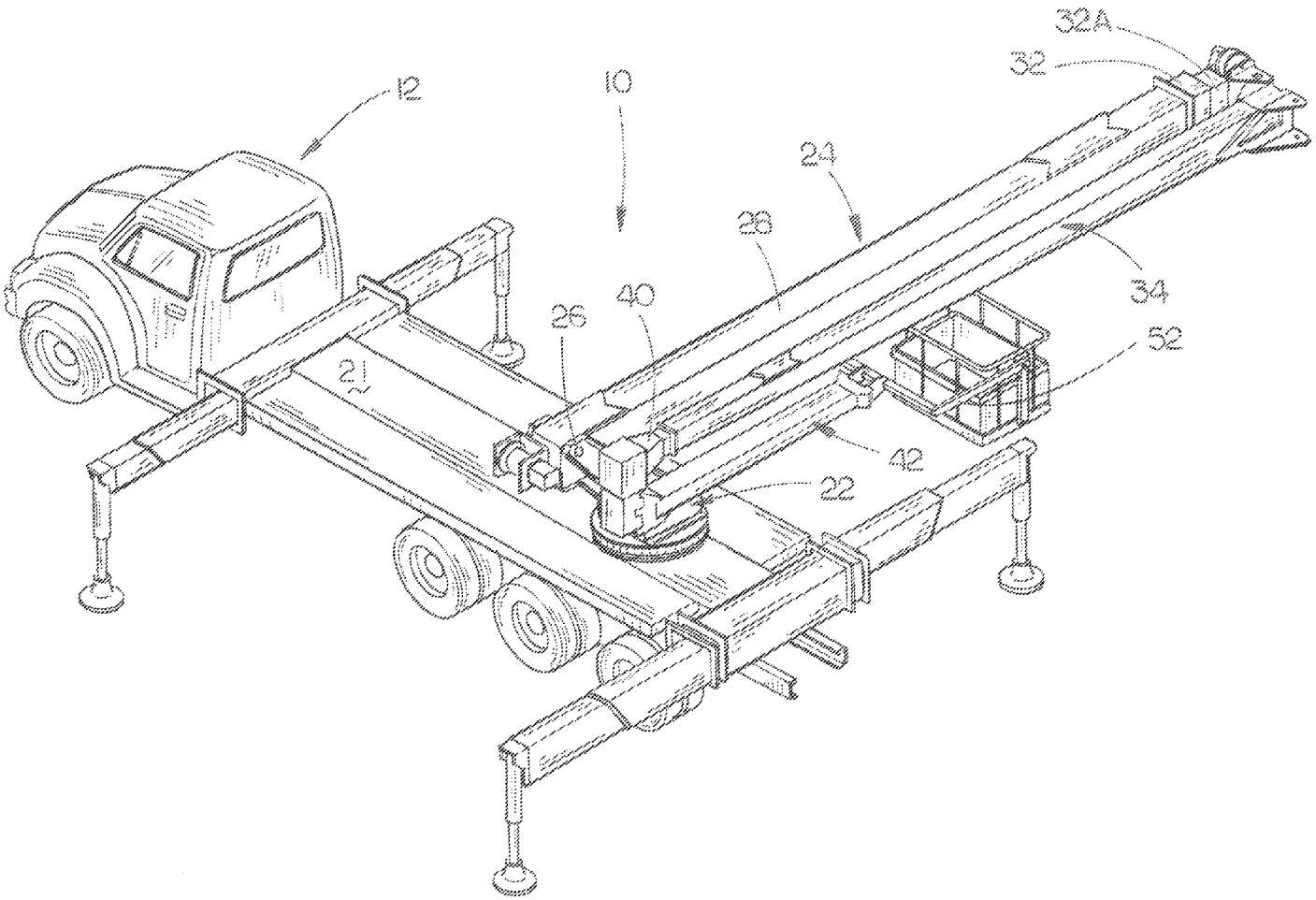
FIG. 3 is a rear perspective view illustrating the main boom having been swung outwardly from the vehicle and wherein the jib boom and extension boom are still in their stowed positions.
Figure 4:
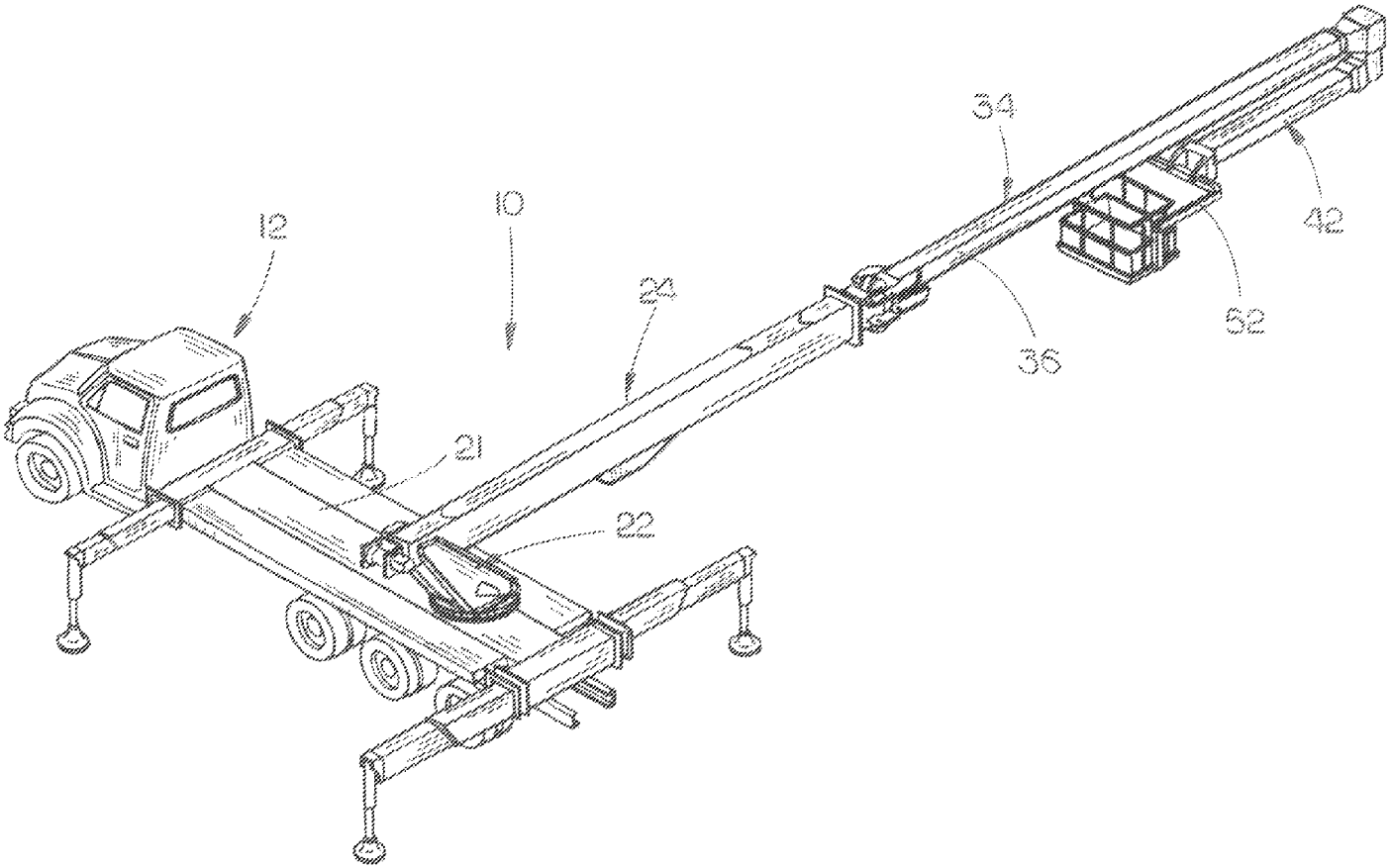
FIG. 4 is a view similar to FIG. 3 except that the jib boom has been extended outwardly from the main boom.
Figure 5:
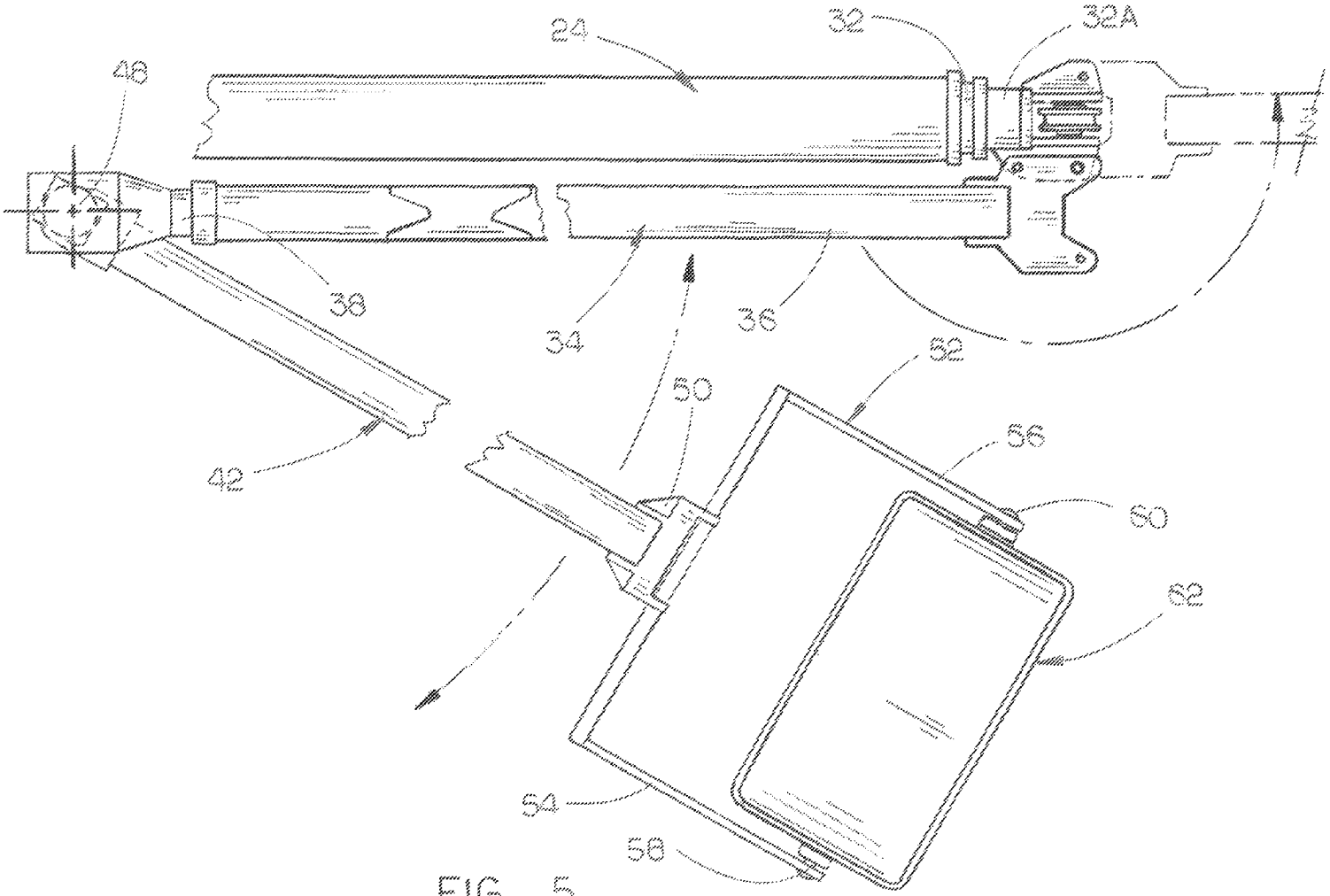
FIG. 5 is a partial top elevational view illustrating the manner in which the extension boom may be pivotally moved with respect to the jib boom.
Figure 6:
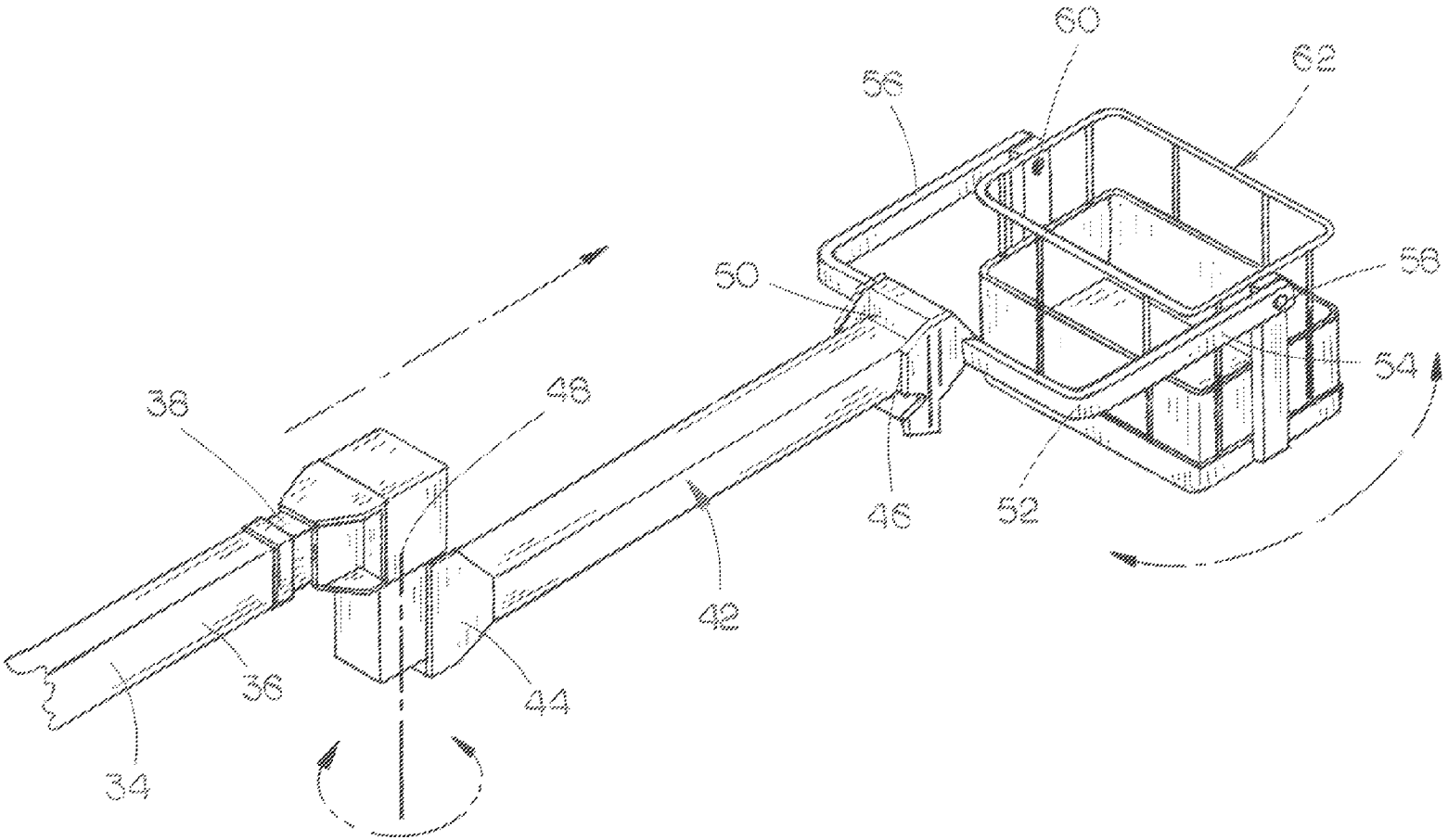
FIG. 6 is a partial perspective view illustrating the extension boom having been pivotally moved to a position wherein it is parallel to the jib boom.
Figure 7:
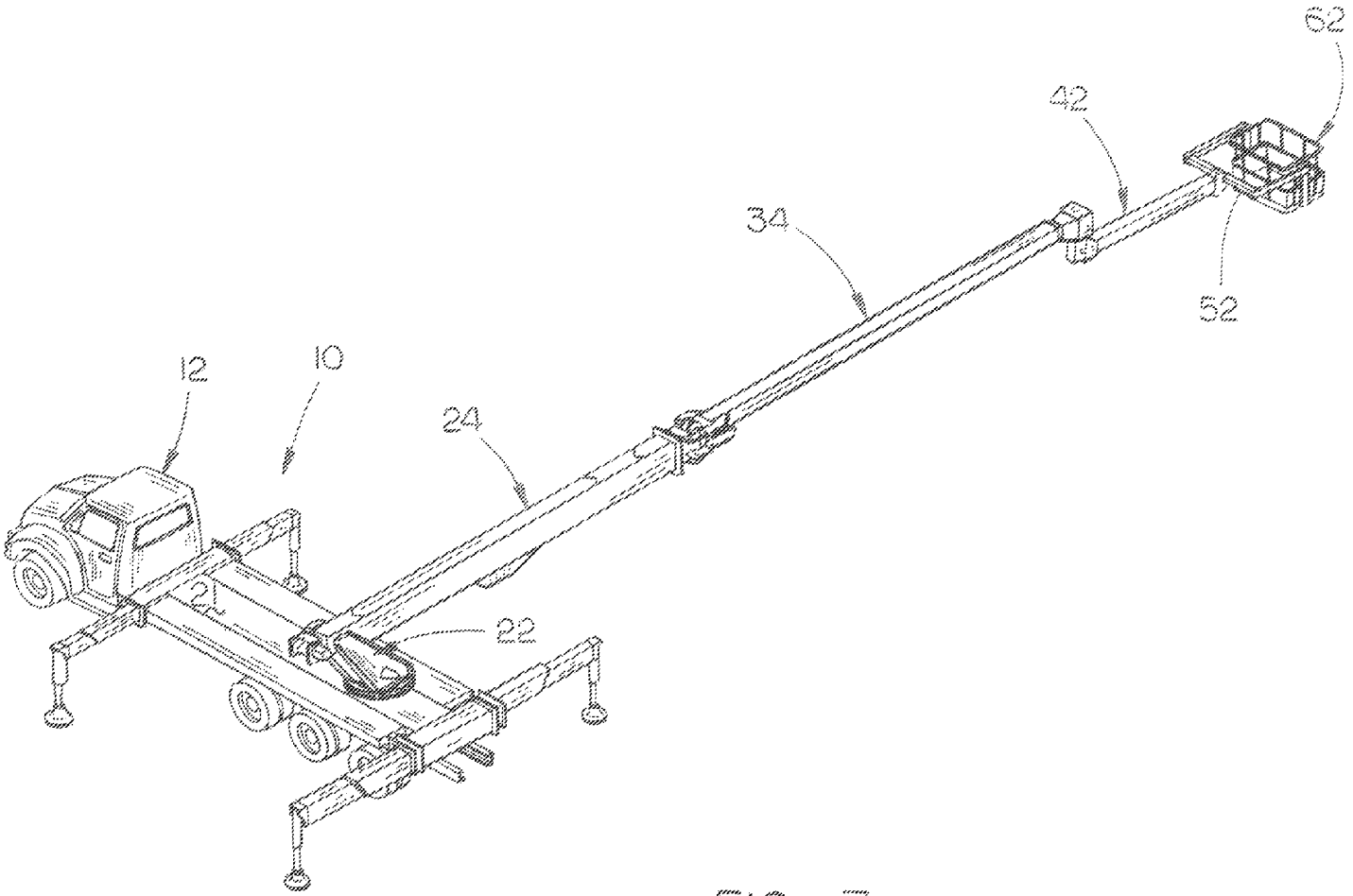
FIG. 7 is a view similar to FIG. 5 except that the extension boom has been moved to its extended position.
Figure 8:
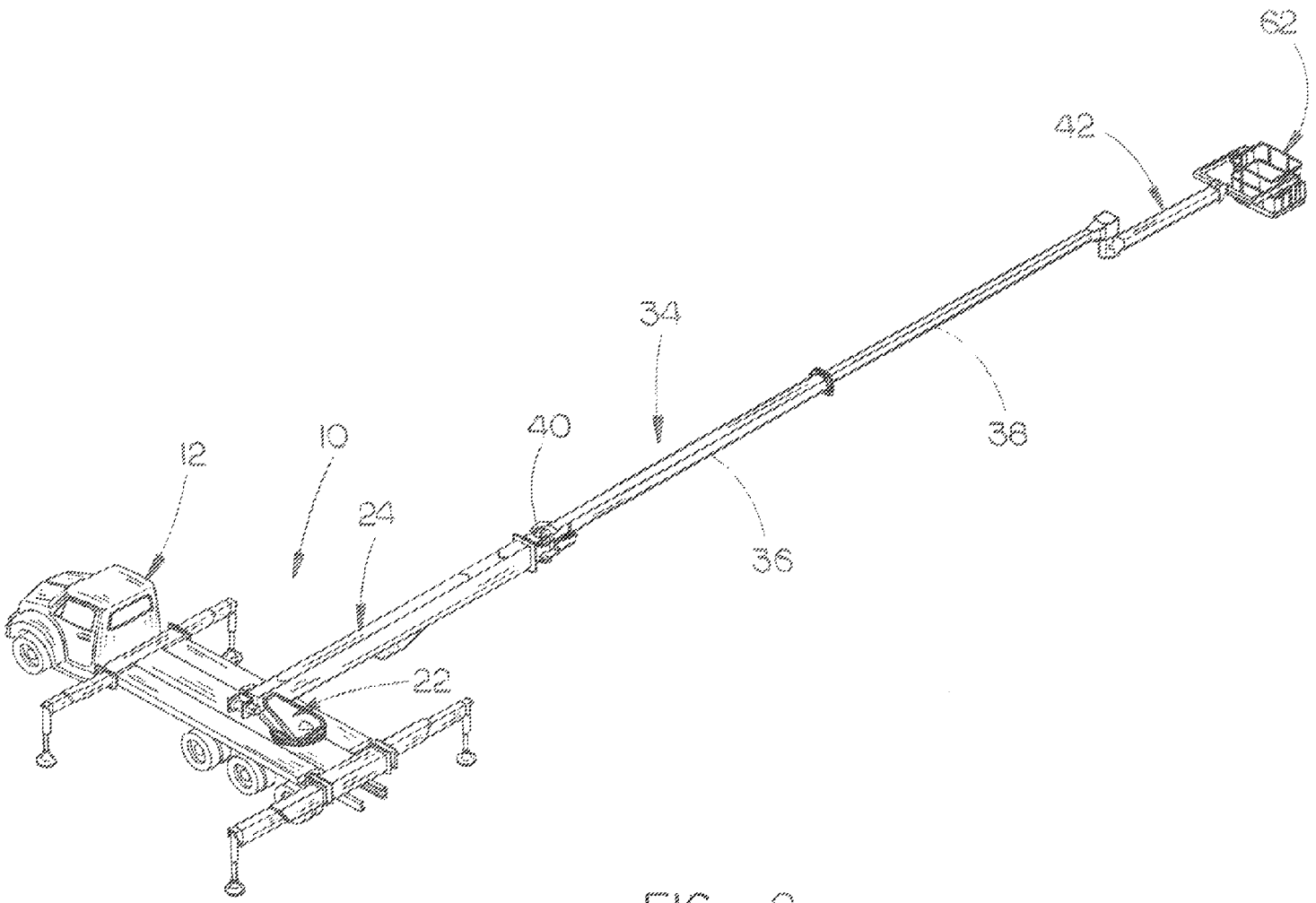
FIG. 8 is a view similar to FIG. 7 except that the inner section of the jib boom has been extended.

Boom structure 24 includes an outer boom section 28 having an inner end 30, and an outer end 31. A plurality of inner boom sections 32 are telescopically and slidably received within one another and within the outer boom section 28. For purposes of description, the innermost inner boom section 32 will be referred to by the reference 32A (FIG. 3). The inner boom sections 32 are telescopically moved within outer boom section 28 by conventional structure. Further, the pedestal 22 is rotated with respect to the vehicle 12 in conventional fashion. Additionally, the boom section 24 is moved upwardly and downwardly by means of conventional hydraulic cylinders.

Figure 1:
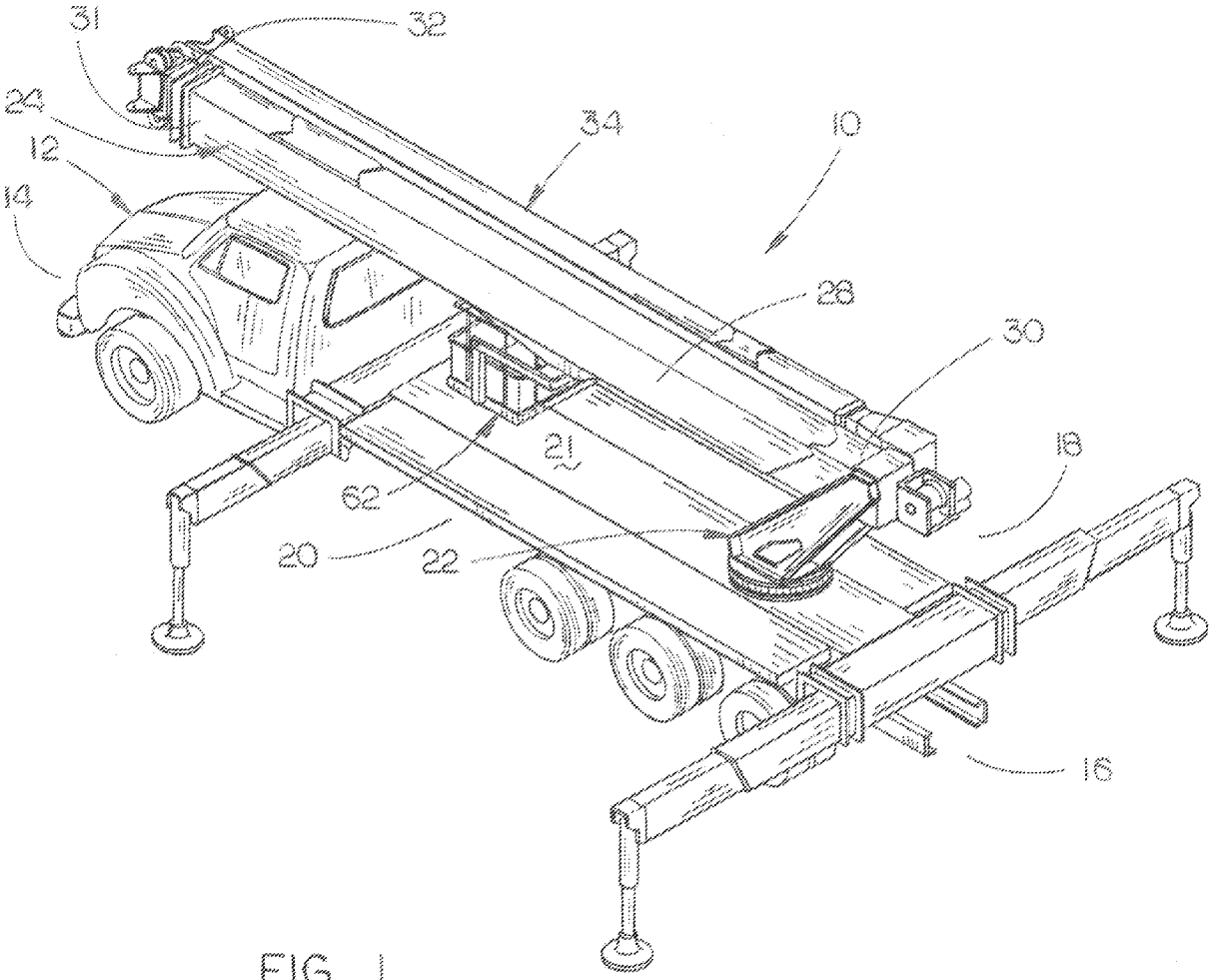
FIG. 1 is a rear perspective view of the vehicle mounted telescopic boom structure of this invention with the main boom, jib boom, extension boom and personnel basket in the stowed position.

The numeral 34 refers to a jib boom which will normally include an outer jib boom section 36 and an inner jib boom section 38 which is telescopically movably mounted within outer jib boom section 36. The inner end 40 of jib boom 34 is pivotally secured to the outer end of the innermost boom section 32A so that the jib boom 34 may be pivotally moved from the stowed position, as seen in FIG. 1, to an extended position wherein jib boom 34 is parallel to and extends outwardly from the outer end of the boom structure in conventional fashion. The jib boom 34 is pivotally connected to the innermost boom section 32A which is disclosed in U.S. Pat. No. 7,926,670, the disclosure of which is incorporated herein by reference to complete this disclosure if necessary.

The numeral 42 refers to an extension boom having an inner end 44 and an outer end 46. The outer end of jib boom 34 and the inner end of extension boom 42 are pivotally connected together about a vertical axis which is generally referred to by the reference numeral 48. The vertical pivotal connection between jib boom 34 and extension boom 42 permits the extension boom 42 to be pivotally moved from a stowed position directly below jib boom 34 to an operative position. The extension boom 42 is pivotally moved with respect to jib boom 34 by conventional means such as a gear motor, hydraulic cylinders, etc.

The outer end of extension boom 42 has a mount 50 thereon which is secured to a generally U-shaped yoke 52 which includes horizontally spaced-apart legs 54 and 56. The ends of legs 54 and 56 are pivotally secured, about horizontal axes 58 and 60, to opposite sides of personnel basket 62.

The invention is used as follows: Assuming that the boom structure 24, jib boom 34 and extension boom 42 are in their stowed positions, as illustrated in FIG. 1, with the personnel basket 62 being positioned on the deck of the vehicle 12, the structure of this invention is utilized as follows.

The boom structure 24 will be raised slightly from its stowed position which will cause the jib boom 34, extension boom 42 and personnel basket 62 to be also raised therewith which will cause the personnel basket 62 to be raised from its engagement with the deck 21 of the vehicle. The boom structure 24 will then be pivotally moved outwardly by the pedestal 22. The jib boom 34 will then be pivotally moved with respect to the boom structure 24 until it is in alignment with the boom structure 24 and will be locked into that position. The extension boom 42 will then be pivotally moved with respect to the jib boom 34 until it is in alignment with the jib boom 34 and locked in that position. The boom structure 24 will then be pivotally moved to its desired location with the inner boom sections 32 being extended to increase the length of the boom structure. The jib boom 34 may also be extended if needed. The extension boom 42 gives added reach to the boom structure.

When the work has been performed on the power pole or transmission line, and it is desired to move the vehicle 12 to the next location, the boom structure 24 will be lowered and retracted as will the jib boom 34. The retracted jib boom 34 is then pivotally moved from its operative position to its stowed position at one side of the boom structure 24. The extension boom 42 will then be pivotally moved with respect to jib boom 34 so that it is positioned in its stowed position beneath (under) the jib boom 34. The boom structure 24, jib boom 34, extension boom 42 and personnel basket 62 are then lowered so that the boom structure 24 rests on its supporting structure and so that the personnel basket 62 is positioned on the deck 21 of the vehicle beneath the extension boom 42 and jib boom 34.

Thus it can be seen that the boom structure of this invention may be moved from its stowed position to its operative position and work can be performed at high elevations without disconnecting the personnel basket from the boom structure at any time during the set-up or during the stowing. Thus it can be seen that the invention accomplishes at least all of its stated objectives.

Although the invention has been described in language that is specific to certain structures and methodological steps, it is to be understood that the invention defined in the appended claims is not necessarily limited to the specific structures and/or steps described. Rather, the specific aspects and steps are described as forms of implementing the claimed invention. Since many embodiments of the invention can be practiced without departing from the spirit and scope of the invention, the invention resides in the claims hereinafter appended.

We claim:

1. In combination:

a self-propelled vehicle having forward and rearward ends and opposite sides;

said vehicle including a cab at the forward end thereof and a deck, having rearward and forward ends and opposite sides, extending rearwardly from said cab;

an upstanding pedestal rotatably mounted, about a vertical axis, on said vehicle adjacent said rearward end of said deck;

a telescoping boom structure including an elongated outer boom section, having inner and outer ends and opposite sides, with at least one elongated inner boom section, having inner and outer ends, telescopically received thereby;

said inner end of said boom structure being pivotally secured, about a horizontal axis, to said pedestal;

said boom structure being movable between a stowed position and an operative position;

an elongated jib boom having inner and outer ends;

said inner end of said jib boom being pivotally secured to said outer end of said inner boom section, about a vertical axis, whereby said jib boom is movable between a first operative position and a second stowed position relative to said boom structure;

said jib boom, when in said first operative position, being generally parallel to and extending outwardly from said inner boom section;

said jib boom, when in said second stowed position, extending from said outer end of said inner boom section towards said inner end of said boom structure adjacent one side of said outer boom section;

an elongated extension boom having first and second ends;

said first end of said extension boom being pivotally secured about a vertical axis to said outer end of said jib boom whereby said extension boom is pivotable from a first stowed position, said first stowed position having an entire longitudinal axis of the extension boom parallel to and directly beneath a longitudinal axis of the jib boom, to operative angular positions with respect to said jib boom;

and a personnel basket;

said second end of said extension boom being operatively pivotally secured, about a horizontal axis, to said personnel basket;

the pivotal connection of said outer end of said jib boom and said first end of said boom extension and the connection between said second end of said extension boom and said personnel basket permitting said personnel basket to be placed on said deck of said vehicle adjacent said forward end of said deck below said boom structure and below said jib boom when said boom structure, said jib boom and said extension boom are in said stowed positions.

2. The combination of claim 1 wherein a U-shaped yoke is pivotally secured, about a horizontal axis to said personnel basket and wherein said second end of said extension boom is secured to said yoke.

* * * * *